US007002431B2

(12) United States Patent
Lenz et al.

(10) Patent No.: US 7,002,431 B2
(45) Date of Patent: Feb. 21, 2006

(54) TRANSITION FROM A WAVEGUIDE TO A MICROSTRIP HAVING A SECURED ARRANGEMENT

(75) Inventors: Sigmund Lenz, Aspach (DE); Achim Strouhal, Murrhardt (DE); Siegbert Martin, Oppenweiler (DE)

(73) Assignee: Marconi Commucations GmbH, Backnang (DE)

( * ) Notice: Subject to any disclaimer, the term of this patent is extended or adjusted under 35 U.S.C. 154(b) by 0 days.

(21) Appl. No.: 10/937,131

(22) Filed: Sep. 9, 2004

(65) Prior Publication Data

US 2005/0040911 A1 Feb. 24, 2005

Related U.S. Application Data

(63) Continuation of application No. 10/031,729, filed as application No. PCT/IB00/01140 on Jul. 19, 2000, now abandoned.

(30) Foreign Application Priority Data

Jul. 22, 1999 (DE) ..... 199 34 351

(51) Int. Cl.
*H01P 5/107* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS 5,374,938 A * 12/1994 Hatazawa et al. ..... 343/756
5,982,250 A * 11/1999 Hung et al. ..... 333/26
6,239,669 B1 * 5/2001 Koriyama et al. ..... 333/26
6,396,364 B1 * 5/2002 Qvist ..... 333/26

* cited by examiner

*Primary Examiner*—Benny Lee
(74) *Attorney, Agent, or Firm*—Taylor & Aust, P.C.

(57) ABSTRACT

A transition from a waveguide to a microstrip, including a substrate having a plurality of ground surfaces superimposed on one another, the microstrip extending on the substrate and a plurality of through-contacts providing electrical connectivity to the plurality of ground surfaces. Wherein the waveguide includes a waveguide wall with an opening therein, the substrate projecting through the opening into the waveguide such that at least a portion of the microstrip is disposed within the waveguide, at least one of the plurality of ground surfaces being in contact with the waveguide wall.

6 Claims, 2 Drawing Sheets

TRANSITION FROM A WAVEGUIDE TO A MICROSTRIP HAVING A SECURED ARRANGEMENT

This is a continuation of Application No. 10/031,729 filed May 13, 2002, now abandoned, which is a 371 of PCT/IB00/01140 filed Jul. 19, 2000.

BACKGROUND OF THE INVENTION

1. Field of the Invention

The invention relates to a transition from a waveguide to a microstrip, and more particularly, to a microstrip extending, on a substrate, projecting through an opening into a waveguide and a ground line associated therewith.

2. Description of the Related Art

A transition from a waveguide to a microstrip is known from U.S. Pat. No. 5,202,648. Wherein, a microstrip is extended on an upper side of a substrate and an associated ground line, consisting of a conductive surface on an opposite side of the substrate, contacts the waveguide wall. A problem is that a waveguide and a contact strip designed in this way has a reflection attenuation that is frequently too low and a transmission attenuation which is too high.

What is needed in the art is a transition, which has the highest possible reflection attenuation and the lowest possible transmission attenuation.

SUMMARY OF THE INVENTION

A ground line associated with a microstrip includes a plurality of ground surfaces superimposed on one another, all of which contact one another by way of through-contacts in a substrate. The multi-layer ground line produces a more favorable field conversion from the microstrip to the waveguide, thereby a high reflection attenuation and a low transmission attenuation results.

A through-plating is provided in the substrate at the end of the microstrip which acts as an antenna and which projects into the waveguide, thus transition bandwidth is enlarged.

To make a good contact between the multi-layer ground line and the waveguide wall, it is expedient for ground surfaces to be applied to the substrate on both sides thereof, next to the microstrip and for these ground surfaces to be in contact with the ground surfaces, that are superimposed on one another in the substrate via through-contacts (vias). Advantageously, the substrate is fixed, by at least one screw, on a support, on the waveguide wall. The screw is guided through the ground surfaces to the support and electrical contact is made between the ground surfaces and the support.

A low transmission attenuation is achieved by way of the at least one screw having its head on one of the ground surfaces, which is applied to the upper side of the substrate, next to the microstrip and by way of a conductive ribbon that is connected to the waveguide wall, the conductive ribbon being clamped between the screw head and the ground surface. Alternatively, at least one conductive elastic body is inserted between one of the two ground surfaces located to each side of the microstrip and a projection of the waveguide wall projecting over the ground surfaces. Further, a conductive elastic body can be pressed between the head of the at least one screw and the projection of the waveguide wall.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
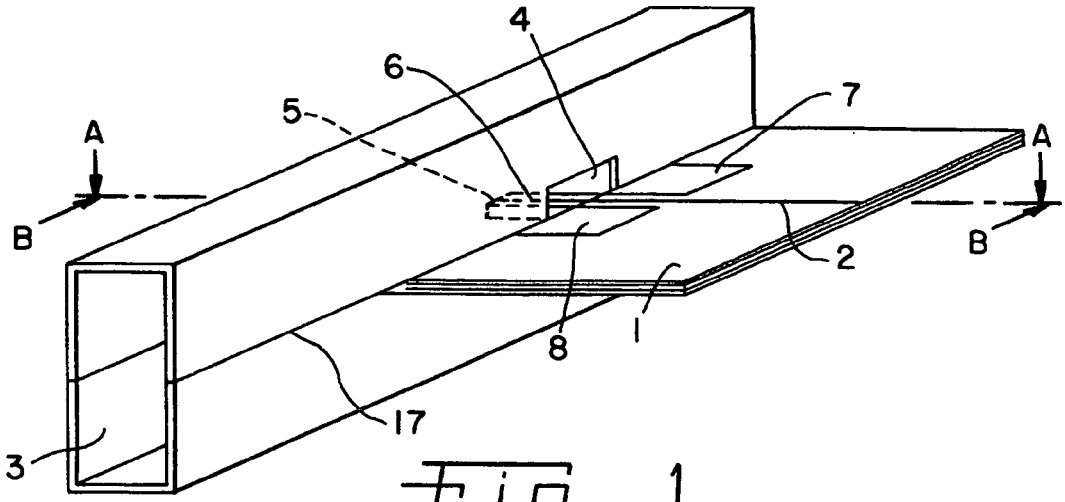
FIG. 1 is a perspective illustration of a transition from a waveguide to a microstrip.

Referring now to the drawings, and more particularly to FIG. 1, there is illustrated a microstrip 2 on a multi-layer substrate 1. Opening 4 is located in a side wall of waveguide 3 and tongue 5, of substrate 1, projects into waveguide 3. The portion of microstrip 2 which extends on tongue 5 is antenna 6 which couples a waveguide field to microstrip 2 and/or vice versa.

Figure 2:
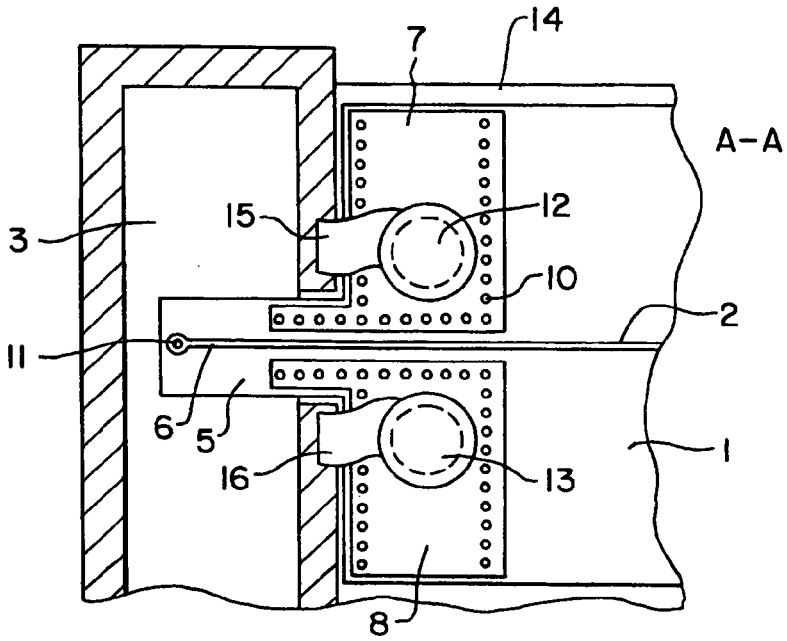
FIG. 2 is a longitudinal section A—A through the transition of FIG. 1.
Figure 3:
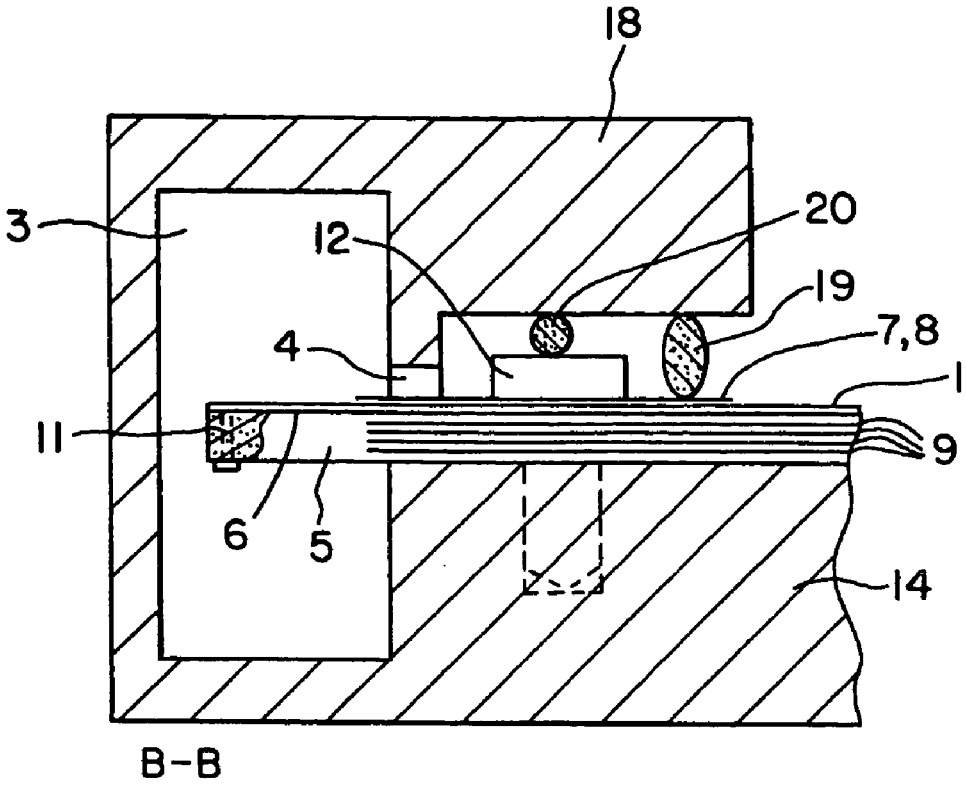
FIG. 3 is a cross-section B—B through the transition of FIG. 1.

Now, additionally referring to FIGS. 2 and 3, there is shown two ground surfaces 7 and 8, in FIG. 2, which are applied to the upper side of substrate 1 next to microstrip 2. A plurality of ground surfaces 9, as illustrated in FIG. 3, are superimposed on one another within multi-layer substrate 1 each having the same ground potential. Cross-section B—B, through waveguide 3 into substrate 1, shown in FIG. 3 shows multi-layer ground surfaces 9 within substrate 1.

Longitudinal section A—A, shown in FIG. 2, shows two symmetrical ground surfaces 7 and 8, respectively, along each side of microstrip 2. Ground surfaces 7 and 8, on the upper side of substrate 1, are connected in an electrically conductive manner by a plurality of through-contacts 10 to other ground surfaces 9, which are superimposed on one another within substrate 1. The position and spacing of through-contacts 10 are selected such that a field propagation, into the intermediate areas between the ground surfaces of multi-layer substrate 1, is prevented since the function of circuits arranged in individual substrate layers, are thereby interfered with.

Ground surfaces 9 of substrate 1, preferably project some tenths of a millimeter into waveguide 3, thereby increasing the positional tolerance of substrate 1 with respect to waveguide 3. The field configuration beneath microstrip 2 in waveguide 3 closely depends on the position of ground surfaces 9. If the position of substrate 1 is slightly changed the field remains unchanged due to the positional tolerance of ground surfaces 9. At an operational frequency of, for example, 10 GHz, a penetration depth of ground surfaces 9 into waveguide 3 of 0.5–1.0 mm is appropriate.

Multi-layer substrate 1 forms a large virtual ground, whereby a field configuration arises which is better transformed into a waveguide wave. The field is shaped more intensely into a field component of the fundamental wave type of waveguide 3 by the larger expansion of the ground (due to the many ground surfaces 9 stacked on top of one another) in the direction of the broad side of waveguide 3.

It can be seen from FIGS. 2 and 3 that a through-plating 11 is provided at the end of antenna 6 of microstrip 2 extending on substrate tongue 5. Through-plating 11 at the end of antenna 6 of microstrip 2 results in a broadening of the frequency band of the transition from waveguide 3 to microstrip 2. Through-plating 11, at the end of antenna 6, is large due to the thicker design of substrate 1, which contributes to a more favorable conversion of the microstrip field into the waveguide field.

Substrate 1 is fixed to support 14 (see FIGS. 2 and 3) beneath opening 4 by at least one screw; there being two screws 12 and 13 in the embodiment shown in FIG. 2. Screws 12 and 13 lie with their heads on ground surfaces 7 and 8 next to microstrip 2 and screws 12 and 13 make an electrical contact between ground surfaces 7 and 8 and ground surfaces 9 superimposed on one another in substrate 1 and support 14. Support 14 additionally serves as a waveguide wall as can be seen in FIG. 3. Since electrical contact is additionally made between ground lines 7 and 8, applied to the upper side of substrate 1, and the waveguide wall, the transmission attenuation of the transition is reduced. This contact can, as shown in FIG. 2, be made by two conductive ribbons 15 and 16, which are clamped at one end between the heads of screws 12 and 13 and conductive surfaces 7 and 8. The other end of conductive ribbons 15 and 16 extend into a wall of waveguide 3 along parting plane 17 of waveguide 3, as shown in FIG. 2. Waveguide 3 includes two half shells that are joined along parting plane 17, as shown in FIG. 1.

FIG. 3 shows another variant for effecting the electrical contact of ground surfaces 7 and 8, and screws 12 and 13, with waveguide wall 14. Waveguide 3 has a wall projection 18 above opening 4 which projects over ground surfaces 7 and 8 on the upper side of substrate 1. One or more conductive elastic bodies 19 are clamped between ground surfaces 7 and 8 on the upper side of substrate 1 and wall projection 18. One or more conductive elastic bodies 20 can also be pressed between the heads of screws 12 and 13 and wall projection 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A transition from a waveguide to a microstrip, comprising:

a substrate including a plurality of ground surfaces superimposed on one another, at least one of said plurality of ground surfaces being interior to said substrate, the microstrip extending on said substrate;

a plurality of through-contacts providing electrical connectivity to said plurality of ground surfaces the waveguide includes a waveguide wall with an opening therein, said substrate projecting through said opening into the waveguide such that at least a portion of the microstrip is disposed within the waveguide, at least one of said plurality of ground surfaces being in contact with said waveguide wall, the waveguide is including a projection; and an elastic body under compression between said projection of the waveguide and said substrate.

2. The transition of claim 1, further comprising a through-plating in said substrate at an end of the microstrip, said through-plating disposed within the waveguide; wherein said end of the microstrip acts as an antenna.

3. The transition of claim 1, further comprising a first ground surface and a second ground surface, said first ground surface being superimposed on a surface of said substrate adjacent to a side of the microstrip and said second ground surface being superimposed on the surface of said substrate adjacent to an other side of the microstrip, said first and second ground surfaces being in contact with at least one of said plurality of ground surfaces via at least one of said plurality of through-contacts.

4. A transition from a waveguide to a microstrip, comprising:

a substrate including a plurality of ground surfaces superimposed on one another, at least one of said plurality of ground surfaces being interior to said substrate, the microstrip extending on said substrate;

a plurality of through-contacts providing electrical connectivity to said plurality of ground surfaces;

at least one screw;

a support disposed proximate said waveguide wall, said substrate being fixedly connected to said support by said at least one screw, said at least one screw extending through said plurality of ground surfaces making electrical contact between said ground surfaces and said support, the waveguide includes a waveguide wall with an opening therein, said substrate projecting through said opening into the waveguide such that at least a portion of the microstrip is disposed within the waveguide, at least one of said plurality of ground surfaces being in contact with said waveguide wall; and a conductive ribbon, wherein said at least one screw has a head thereof which lies on one of said plurality of ground surfaces applied to an upper side of said substrate adjacent the microstrip, said conductive ribbon connected to said waveguide wall and clamped between said head of said at least one screw and one of said plurality of ground surfaces.

5. A transition from a waveguide to a microstrip, comprising:

a substrate including a plurality of ground surfaces superimposed on one another, at least one of said plurality of ground surfaces being interior to said substrate, the microstrip extending on said substrate;

a plurality of through-contacts providing electrical connectivity to said plurality of ground surfaces;

a first ground surface and a second ground surface, said first ground surface being superimposed on a surface of said substrate adjacent to a side of the microstrip and said second ground surface being superimposed on the surface of said substrate adjacent to an other side of the microstrip, said first and second ground surfaces being in contact with at least one of said plurality of ground surfaces via at least one of said plurality of through-contacts;

a projection of said waveguide wall; and at least one conductive elastic body being inserted between said projection and at least one of said first ground surface and said second ground surface;

wherein the waveguide includes a waveguide wall with an opening therein, said substrate projecting through said opening into the waveguide such that at least a portion of the microstrip is disposed within the waveguide, at least one of said plurality of ground surfaces being in contact with said waveguide wall.

6. A transition from a waveguide to a microstrip, comprising:

a substrate including a plurality of ground surfaces superimposed on one another, at least one of said plurality of ground surfaces being interior to said substrate, the microstrip extending on said substrate;

a plurality of through-contacts providing electrical connectivity to said plurality of ground surfaces;

at least one screw;

a support disposed proximate said waveguide wall, said substrate being fixedly connected to said support by said at least one screw, said at least one screw extending through said plurality of ground surfaces making electrical contact between said ground surfaces and said support, the waveguide includes a waveguide wall with an opening therein, said substrate projecting through said opening into the waveguide such that at least a portion of the microstrip is disposed within the waveguide, at least one of said plurality of ground surfaces being in contact with said waveguide wall;

a projection of said waveguide wall; and at least one conductive elastic body being inserted between said projection and said at least one screw.

* * * * *

UNITED STATES PATENT AND TRADEMARK OFFICE

CERTIFICATE OF CORRECTION

PATENT NO. : 7,002,431 B2
APPLICATION NO. : 10/937131
DATED : February 21, 2006
INVENTOR(S) : Lenz et al.

It is certified that error appears in the above-identified patent and that said Letters Patent is hereby corrected as shown below:

TITLE PAGE item 54 and Col. 1, Line 2
In the title, please delete "HAVING A SECURED ARRANGEMENT"

COLUMN 3
At line 66, between waveguide and including, please delete "is".

Signed and Sealed this

Twelfth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,002,431 B2
APPLICATION NO. : 10/937131
DATED : February 21, 2006
INVENTOR(S) : Lenz et al.

It is certified that error appears in the above-identified patent and that said Letters Patent is hereby corrected as shown below:

On the Title Page, Item (73), under "Assignee", in Column 1, Line 1, delete "Commucations" and insert -- Communications --, therefor.

Signed and Sealed this

Seventeenth Day of February, 2009

John Doll

JOHN DOLL
*Acting Director of the United States Patent and Trademark Office*